United States Patent [19]

Mohelnicky et al.

[11] Patent Number: 4,579,151

[45] Date of Patent: Apr. 1, 1986

[54] MACHINE FOR MAKING A PARTLY WOVEN PARTLY KNITTED FABRIC

[75] Inventors: Josef Mohelnicky; Hisef Natejka, both of Prague; Miloslav Jisa, Liberec; Stanislav Korinek, Vsetin, all of Czechoslovakia

[73] Assignee: Stani vyzkumny ustav textilni, Liberec, Czechoslovakia

[21] Appl. No.: 633,860

[22] Filed: Jul. 24, 1984

[51] Int. Cl.[4] ..... D03D 47/00

[52] U.S. Cl. ..... 139/429

[58] Field of Search ..... 139/1 R, 11 R, 11 A, 139/429

[56] References Cited

U.S. PATENT DOCUMENTS

| | | | |
|---|---|---|---|
| 3,556,165 | 1/1971 | Zmatlik et al. | 139/429 |
| 3,664,380 | 5/1972 | Haberhauer et al. | 139/429 |
| 3,735,606 | 5/1973 | Pollard | 139/11 |
| 3,746,051 | 7/1973 | Mohelnicky et al. | 139/429 |
| 4,176,530 | 12/1979 | Cheynet | 139/1 R |

*Primary Examiner*—Henry S. Jaudon

[57] ABSTRACT

Machine for manufacturing knit-woven fabrics comprising stitch wales and warp thread which lie between said stitch wales and which are interlaced, in a weave, by connecting loops of said stitches. The machine has lapping elements which are movable between an upper position and a lower position, and cooperate with knitting needles which are mounted, on the one hand, for rotation in a needle bed in a plane parallel to the beat-up edge of the fabric and, on the other hand, for reciprocation in spacings of a guide comb arranged parallel to the beat-up edge of the fabric. The mechanism for controlling the motion of the needle bed is associated with mechanism for producing a reciprocatory side motion of one of members of the pair of needle bed and guide comb relative to the other in order to control a multiphase motion of the knitting needles in sheds following one after the other. During which motion, in the odd-numbered sheds, the paths of the hooks of the knitting needles are oriented from the front position into the left-hand lapping position and back again into the front position, and in the even-numbered sheds, from the front position into the right-hand lapping position and back again into the front position, said paths for the hooks for the knitting needles being oriented symmetrically to the longitudinal axes of the knitting needles while the needles are in their front position.

8 Claims, 24 Drawing Figures

6a
6b
16
12
I
4a
VII
20
A
31
18
35
2
22
10
17
III
36

61
4a
6a
6b
VIII
62
12
32
50
22
20
21
31
18
35
2
60
33
17
36
63
32
10
FIG. 6a1
2
6a
6b
IX
II
12
B
19
31
17
35
4a
22
20
33
36
2
10
32

6a
6b
63
2
12
20
19
31
17
51
60
35
22
4a
33
10
61
2
X
32
FIG. 6b1
6a
6b
12
51
2
20
31
17
35
4a
C
33
18
36
2
22
10
32

6a
6b
4a
22
17
A
31
21
35
2
VII
IV
18
12
III
36
10
32

MACHINE FOR MAKING A PARTLY WOVEN PARTLY KNITTED FABRIC

This invention represents an improvement upon that described and claimed in the coassigned U.S. Pat. No. 3,746,051 of Mohelnicky et al, dated July 17, 1978.

The invention relates to a knit-weaving machine, that is, a machine for making a partly woven and partly knitted fabric. The machine comprises a slay together with a reed, means for reciprocating the slay between a front and a rear position, a loom harness for warp threads, means for controlling the harness motion, and a knitting mechanism for forming a warpknit binding. Said knitting mechanism comprises a system of lapping elements threaded-in with weft threads withdrawn from a supply disposed outside the shed of the weaving machine or loom, means for controlling the motion of said lapping elements, a system of knitting needles having closeable hooks and arranged in a needle bed, and means for controlling the motion of said needle bed between a front position thereof in which the knitting needle hooks are disposed in front of the beat-up edge of the fabric being made and in parallel to the warp threads, and a rear position in the open shed, said motion of the needle bed being synchronized with the motion of the lapping elements.

The above referred to U.S. Pat. No. 3,746,051 discloses and claims a machine such as that described above. In such prior machine, each of the lapping elements is mounted for swinging in a transverse needle bed disposed in front of the weaving harness, each lapping element having a stem which is provided in the middle with a tongue-like lapping arm terminating in a guide eye threaded-in with a weft thread. The stem terminates in a tooth meshing in a rack bar which is caused to reciprocate by means of a cam mechanism.

In their intermediate initial positions, the arms of the lapping elements are oriented in parallel with the warp threads, lie in the closed shed position between the warp threads, and can swing in the open shed position. During the slay movement, the lapping arms pass through the spacings in the reed.

In each open shed, the lapping elements are synchronously moved from their initial intermediate position into one of their extreme positions and back again, the lapping elements lapping or introducing weft threads into the open hooks of the knitting needles which are then in their operative, rear position. Due to such reciprocatory movement of the lapping elements, there are formed sectional double wefts in the form of a loop outstanding from the beat-up edge of the fabric. The head portion of these loops are engaged by the knitting needles. During a shed exchange, such sectional wefts return to their initial positions adjacent the beat-up edge of the fabric onto which they are beaten up by the reed.

The present invention has among its objects the simplification of the structure of the above-described knit-weaving machine, to improve the reliability of operation of the knitting mechanism thereof, and to improve the output of the machine and the quality of knit-woven produced by it, while simultaneously reducing the stress imposed upon the weft material, so as to prevent the use of spun yarns as weft threads to be processed.

The above objects are substantially achieved by the knit-weaving machine of the present invention. In such machine the lapping elements, which are movable between an upper position and a lower position, cooperate with knitting needles mounted, on the one hand, for rotation in the needle bed in a plane parallel to the beat-up edge of the fabric being produced, and on the other hand, for reciprocation in the spacings of a guide comb arranged parallel to the beat-up edge of the fabric. The means for controlling the motion of the needle bed is associated with means for producing a reciprocatory side motion of one of the pair made up of the needle bed and the guide comb in order to control a multi-phase motion of the knitting needles in sheds following one after the other. During such motion, in the odd-numbered sheds, the paths of the hooks of the knitting needles are oriented from the front position thereof into the left-hand lapping position and back again into the front position; and in the even-numbered sheds, the paths of the hooks of the knitting needles are oriented from the front position thereof into the right-hand lapping position and back again into the front position, said paths of the hooks of the knitting needles are oriented symmetrically with respect to the longitudinal axes of the knitting needles when the hooks are in their front position.

The multi-phase motion of the knitting needles comprises, in the odd-numbered sheds and in the first phase thereof, a motion of the hooks of the knitting needles along a curvilinear path from the front position in which the knitting needles lie parallel to the warp threads, into the left-hand lapping position in which they lie askew under left-hand weft threads disposed to the left of warp thread groups; in the second phase, the backward motion of the hooks of the knitting needles with entrapped left-hand weft threads are moved along a shorter curvilinear path into an aligned position in which the knitting needles lie again parallel to the warp threads. In the third phase, the hooks move in a straight line into the knock-over front position while the shed is exchanged. In the fourth phase, and in the even-numbered shed, the motion of the hooks of the knitting needles is along a curvilinear path from the front position thereof into the right-hand lapping position in which the knitting needles lie askew under the right-hand weft threads disposed to the right of the warp thread groups. In the fifth phase, the needles and hooks move backwardly into the aligned position, parallel to the warp threads; in the sixth phase the needles and hooks move in straight lines into the knock-over front position, the lapping elements arranged between the harness and the reed making a controlled motion from the initial position above the warp threads in the closed shed into the upper position during the opening of the shed, then into a securing position before the end of the second phase, into the lower position, and then into the initial position while the shed is being closed.

The motions of the needle bed and the slay are synchronized in order to provide a constant spacing between the reed and the hooks of the knitting needles during their operative movements.

The lapping elements are preferably constituted by eyes of an auxiliary heald frame coupled through a lever system with a cam secured on the crankshaft of the loom.

In accordance with a first disclosed, preferred embodiment of the apparatus for controlling the multi-phase knitting needle motion cycle, the guide comb in stationary and the needle bed is provided at either side in an axial direction with a pivot which is reciprocated in a bed of a rotatable support arm and which abuts a rotatable arm a follower of which is guided in the groove of a rotatable axial cam intergral with a first gear which meshes, in a gear ratio of 2:1, with another, second gear secured on the crankshaft of the loom, the support arms for the bed being coupled to the slay via tie rods.

According to another, second disclosed, preferred embodiment of the invention, the guide comb is fixedly attached to a support arm which is mounted for reciprocation between radial cams provided on rotatable vertical shafts which are coupled through helical gears, in a gear ratio of 2:1, to the crankshaft of the loom, the needle bed being provided at either side in an axial direction with a pivot which is rotatable in a bed of the rotable support arms which are coupled through tie rods to the slay.

When compared with orthodox weaving techniques, the machine of the present invention permits the distance between the beat-up edge of the fabric being produced and the harness to be substantially reduced, whereby the geometry of the shed is substantially improved.

With gripper looms, or pneumatic jet weaving machines, the distance between the beat-up edge of the fabric and the harness is considerably longer, since it is required by the arrangement of the beat-up reed and the weft guiding means which have to be disposed on the slay so as not to engage into the shed in the beat-up position of the reed.

In contradistinction, thereto, this distance in the machine of the invention is defined only by the dimensions of the knitting needles which are designed for engaging weft in the open shed. As a result, it is possible to shorten the distance between the beat-up edge and the harness to less than one-half that required by conventional weaving techniques.

Such a reduction of the distance between the beat-up edge of the fabric and the harness in the machine according to the invention, unlike the orthodox weaving technique, allows a reduction of the heald frame stroke and consequently a reduction of the stress imposed upon the warp threads during the operation of the machine.

Another advantage of the machine according to the present invention, in comparison with hitherto known knit-weaving machines, is that the sectional wefts are lapped onto breasts of the knitting needles by means of the auxiliary heald frame, the eyes of which allow the passage of all weft types such as filament yarns, spun yarns, fancy yarns, or knotted yarns. By installing a set of two or more auxiliary heald frames for lapping weft threads onto the breasts of knitting needles, and by the use of a programmed control thereof, it is possible to produce knit-woven fabrics having both various colors and fancy weave patterns.

Another advantage of the invention is that the beat-up reed corresponds to conventional weaving reeds, so that the harness can be threaded-in in accordance with orthodox weaving techniques, which means that they can be threaded-in outside the loom.

The principle of swinging the knitting needles in the beat-up plane, and of lapping the wefts onto the breasts of the needles by means of the auxiliary heald frame, causes the sectional wefts, unlike the heretofore known knit-weaving techniques, to be more reliably seized by the knitting needle hooks, and consequently improves the quality of the knit-woven fabrics produced.

The speed of production of the machine in accordance with the invention does not depend upon the width of fabric to be manufactured, as it is with orthodox looms; with the machine of the invention it is possible to make one or several fabrics adjacent one another without any additional selvedge forming device. The machine of the invention is particularly suitable for use for manufacturing ribbons of usual widths, with optimum utilization of the machine width.

In order that the invention may be better understood and carried into practice, two preferred embodiments thereof will hereinafter described with reference to the accompanying drawings, in which.

Figure 4A:
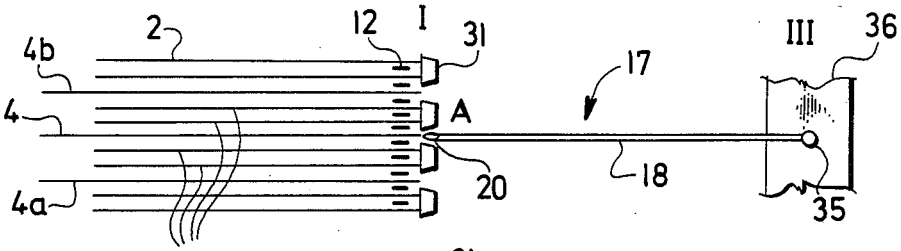
Figure 4B:
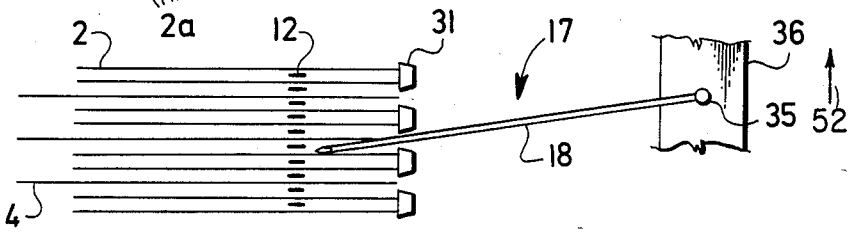
Figure 4B:
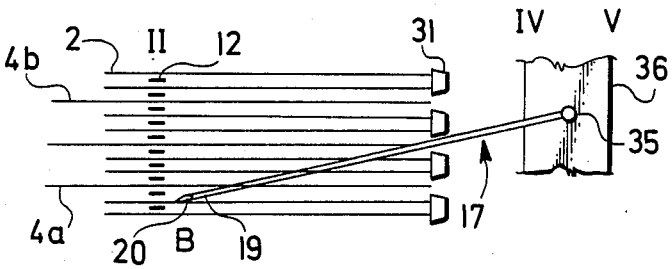
Figure 4C:
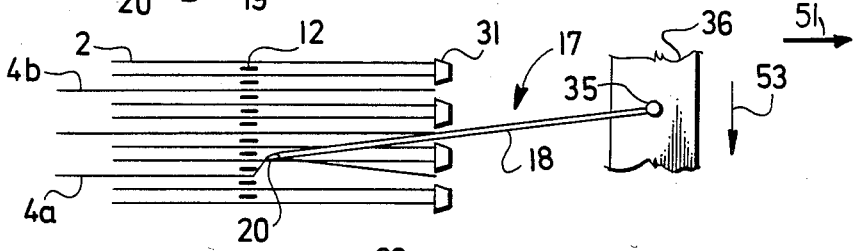
Figure 4C:
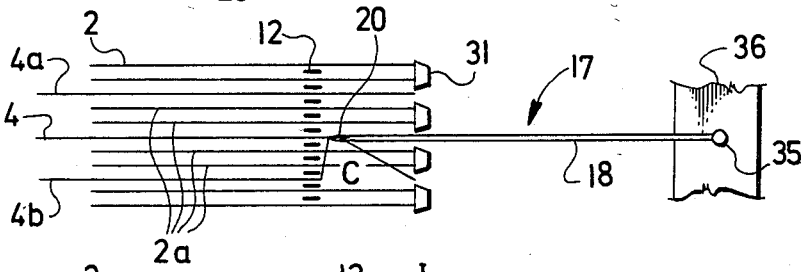
Figure 4A:
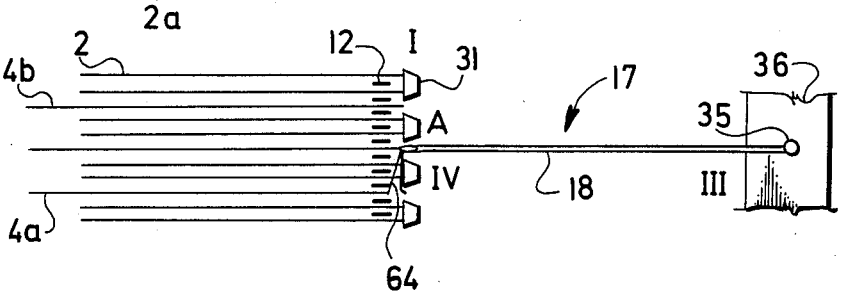
Figure 5D:
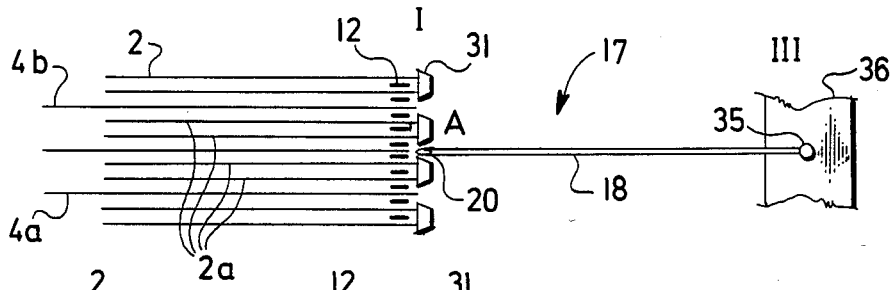
Figure 5E:
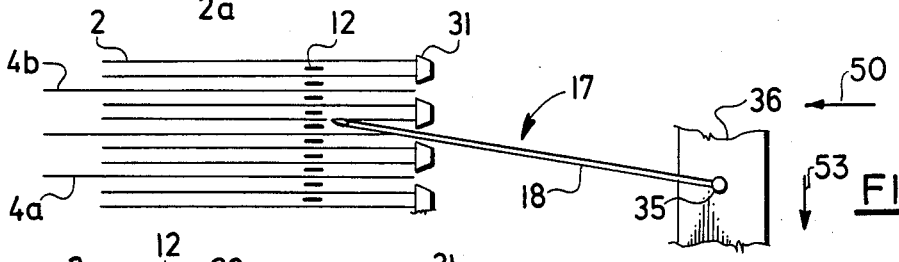
Figure 5E:
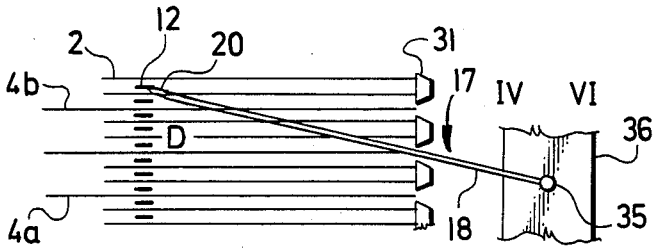
Figure 5F:
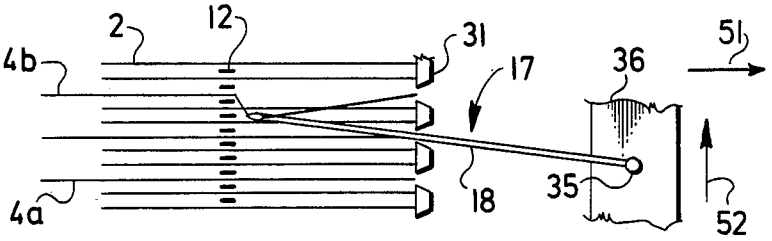
Figure 5F:
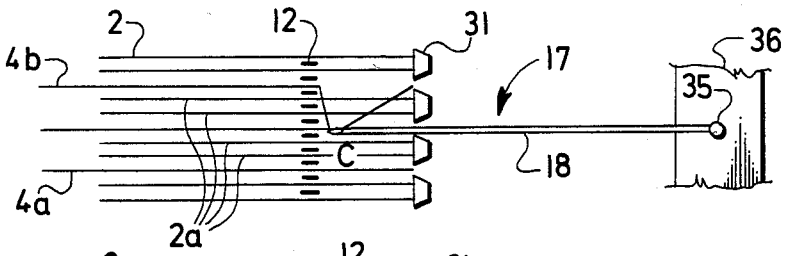
Figure 5D:
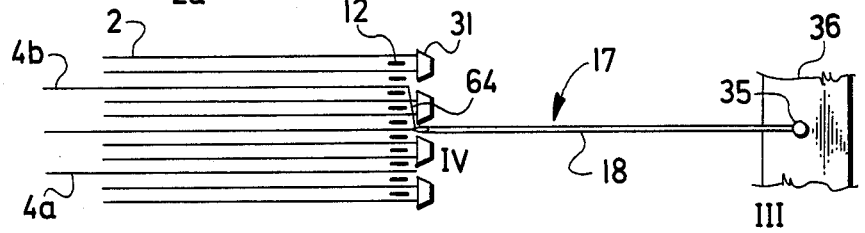
Figures 6A, 6B, 6C:
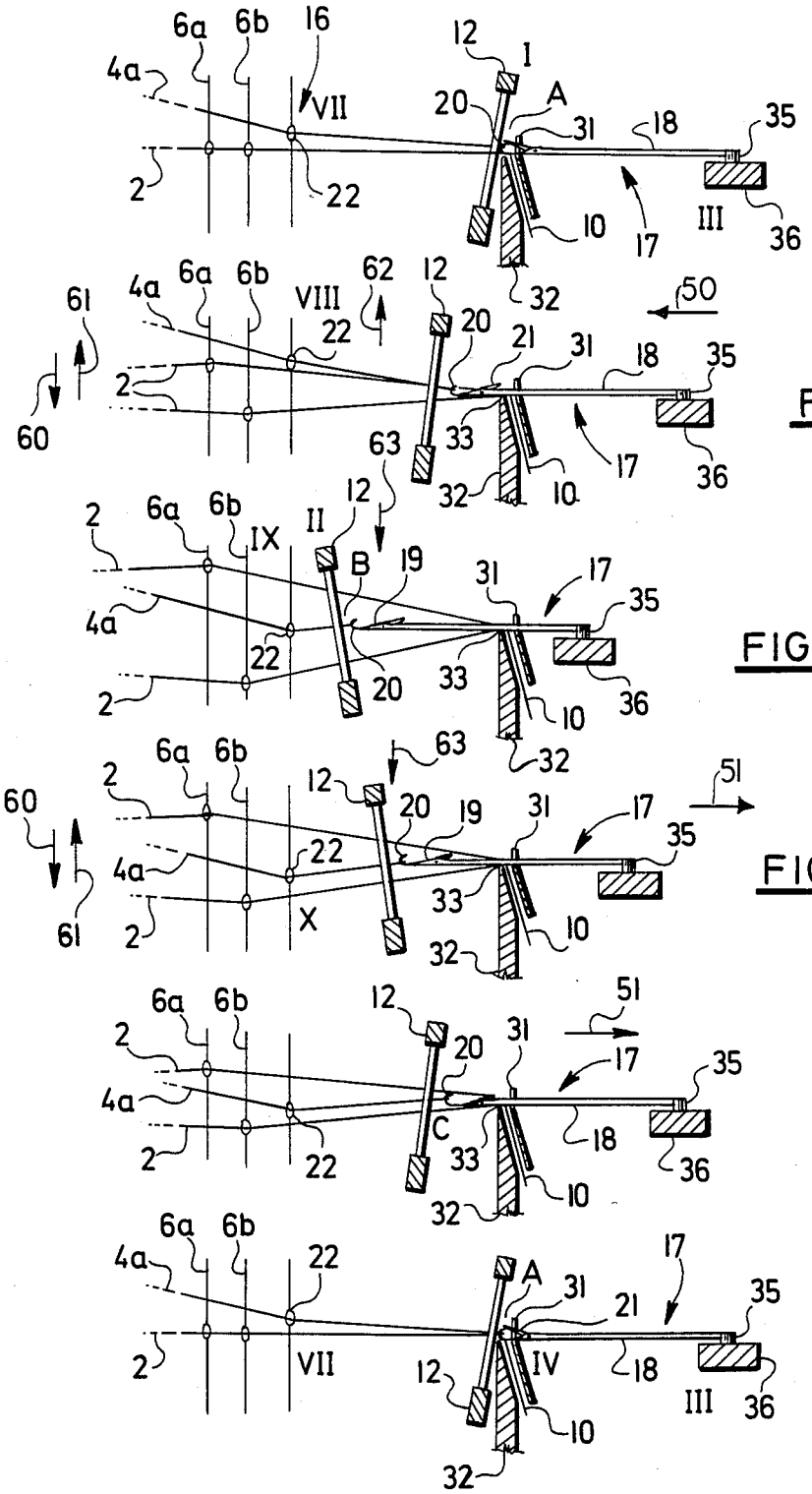

FIGS. 4*a*, 4*a*$_1$. 4*b*, 4*b*$_1$, 4*c*, and 4*a'* are fragmentary views in plan showing the knitting mechanism of the machine in successive individual phases of the first cycle of knitting needle motion;

FIGS. 5*d*, 5*d*$_1$, 5*e*, 5*e*$_1$, 5*f*, and 5*d'* are fragmentary views in plan of the knitting mechanism in sucessive individual phases of a second cycle of knitting needle motion;

FIGS. 6*a*, 6*a*$_1$, 6*b*, 6*b*$_1$, 6*c*, and 6*a'* are fragmentary views in side elevation of the knitting mechanism, such figures showing sucessive phases of the first cycle of knitting needle motion, FIGS. 6*a*, 6*a*$_1$, 6*b*, 6*b*$_1$, 6*c* and 6*a'* corresponding to the respective FIGS. 4*a*, 4*a*$_1$, 4*b*, 4*b*$_1$, 4*c*, and 4*a'*.

Figure 3:
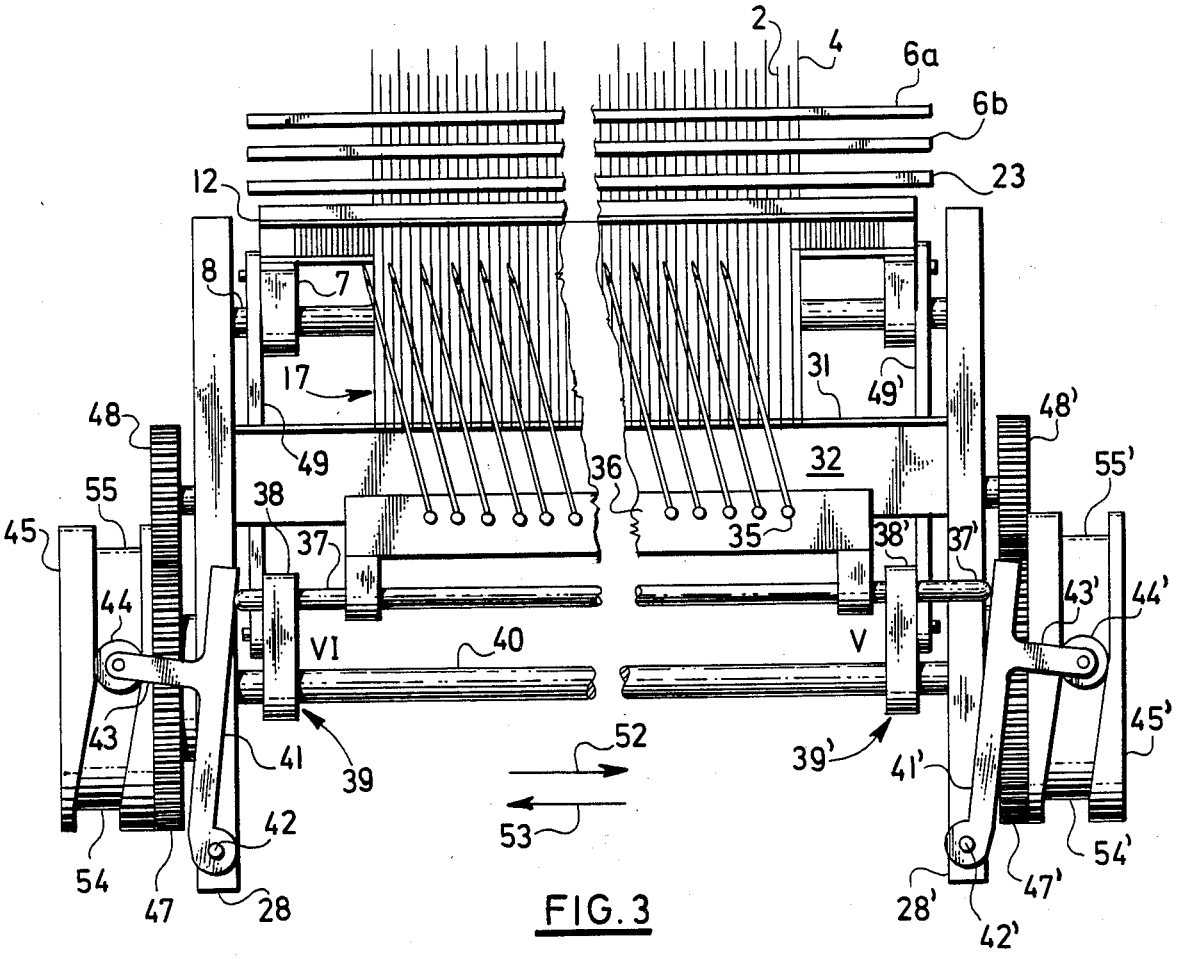
FIG. 3 is a partial view in plan of the machine shown in FIG. 2, the fabric being produced in the machine being omitted.
Figure 7:
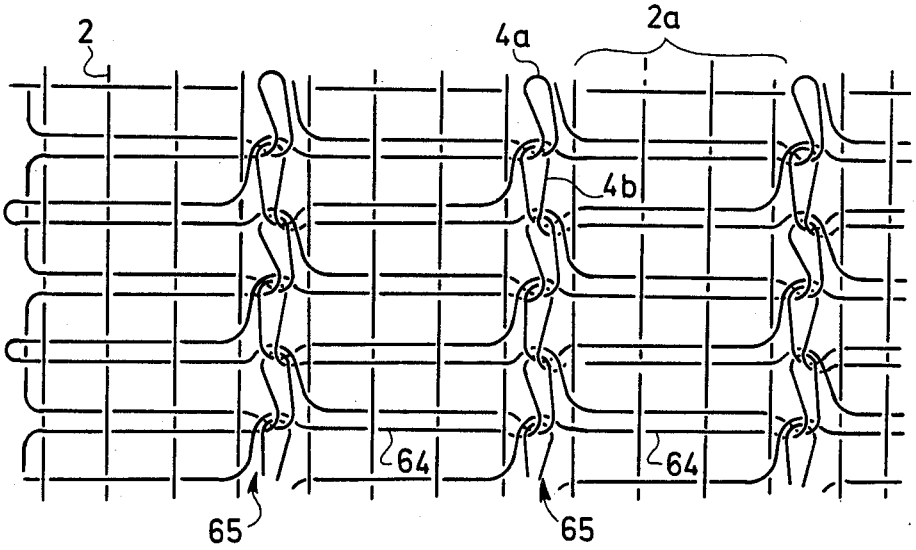
Figure 8:
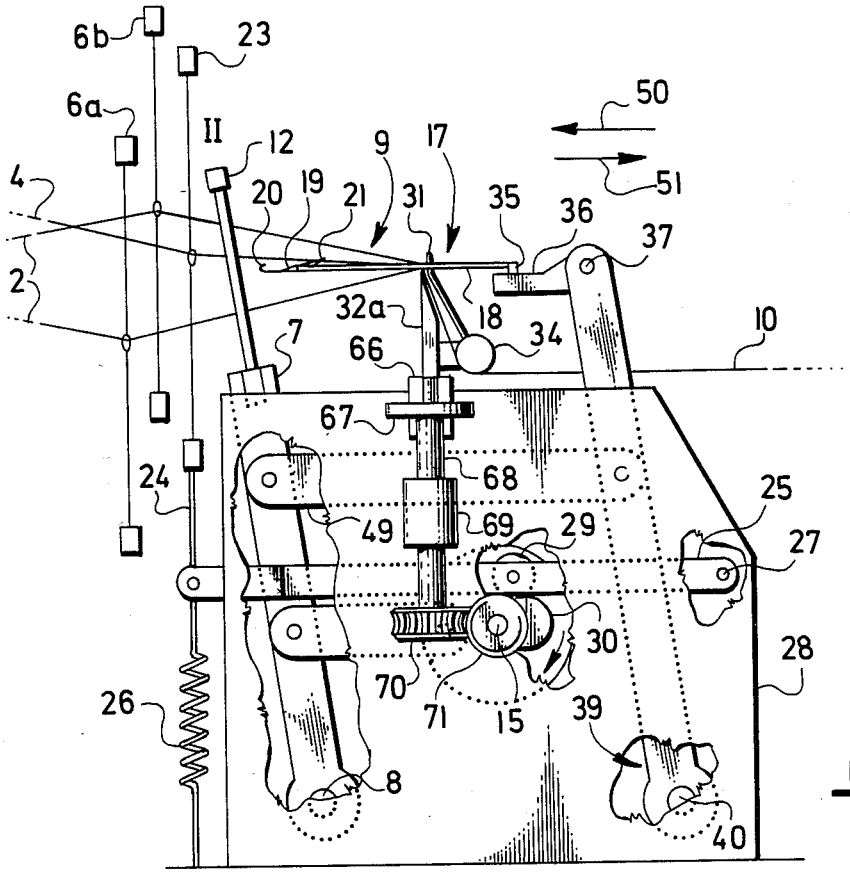
Figure 9:
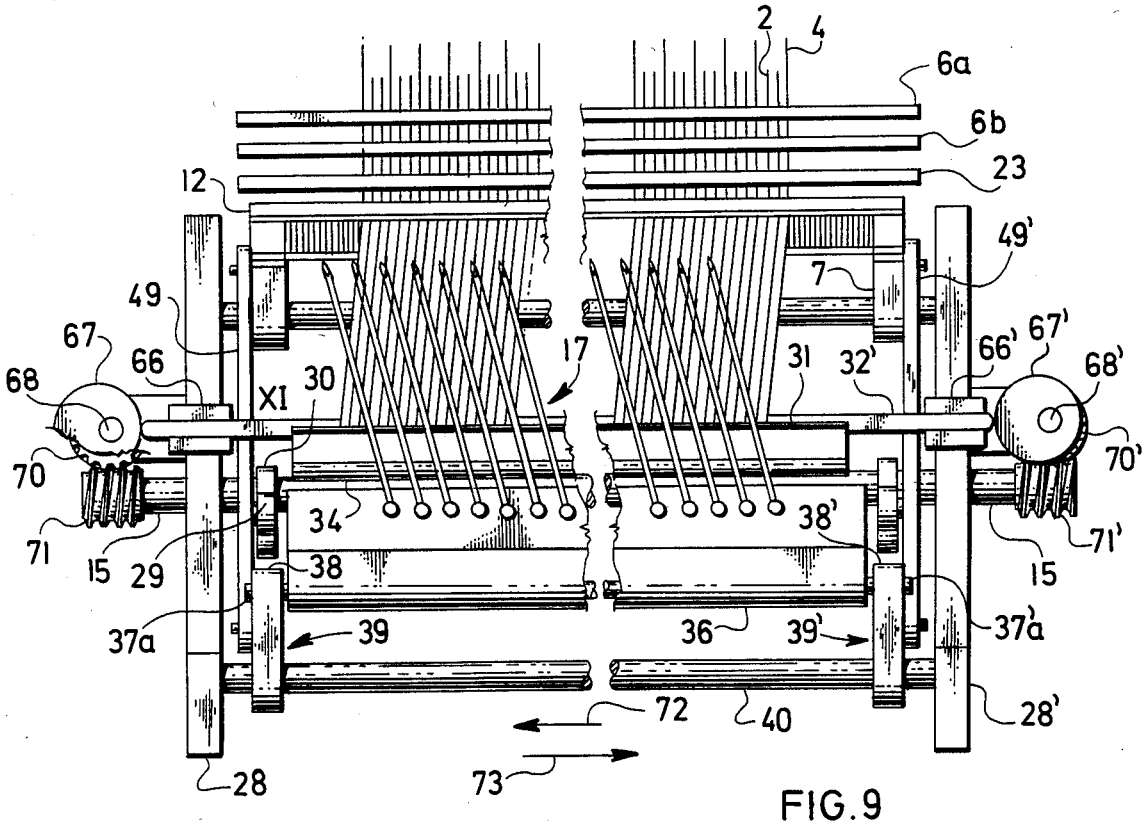

FIG. 7 is a fragmentary view in plan of a knit-woven fabric produced by the machine of the invention;

FIG. 8 is a fragmentary view in side elevation of a second embodiment of the knit weaving machine of the invention, such machine having a modified multi-phase knitting needle motion mechanism; and FIG. 9 is a fragmentary view in plan, similar to FIG. 3, but of the modified machine of FIG. 8, the fabric being omitted in FIG. 9.

Figure 1:
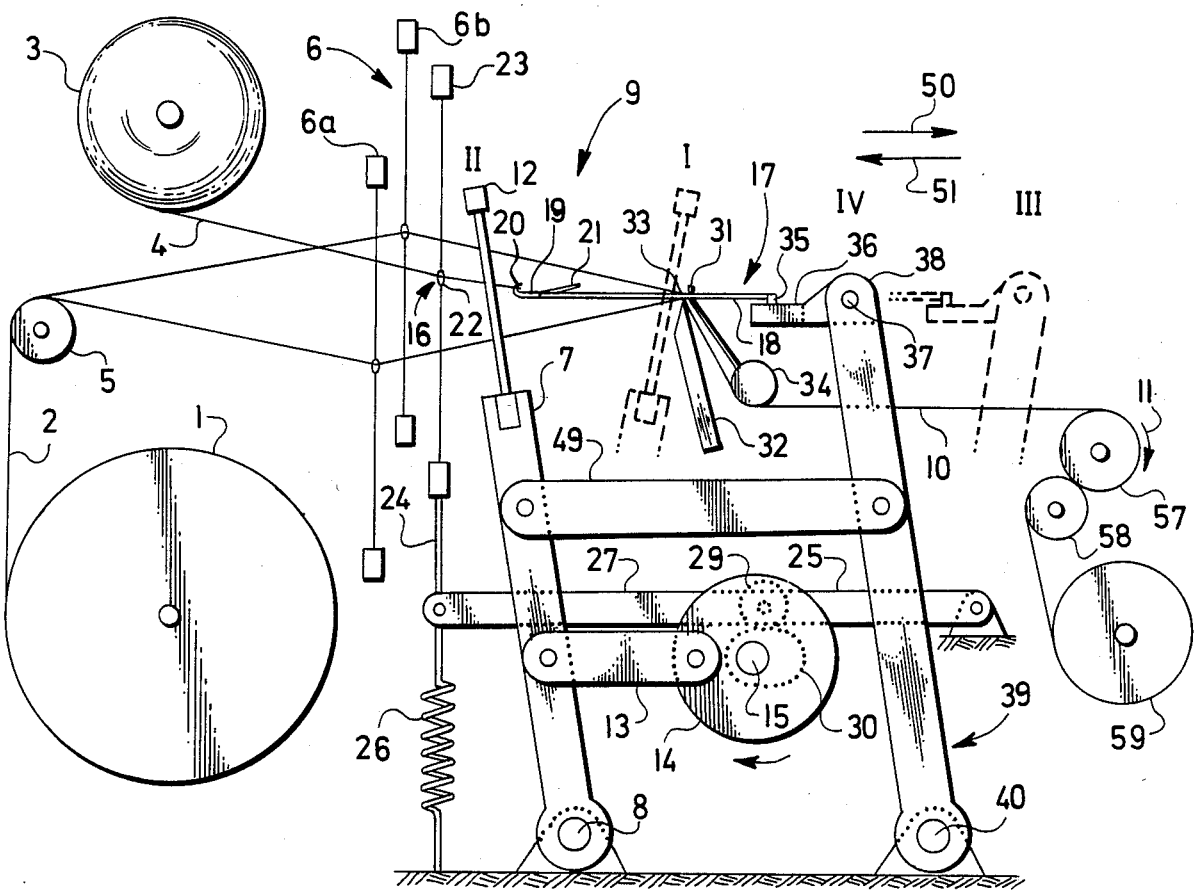
FIG. 1 is a view in side elevation of a first embodiment of knit-weaving machine in accordance with the invention, the side walls of the machine being omitted for clarity of illustration.
Figure 2:
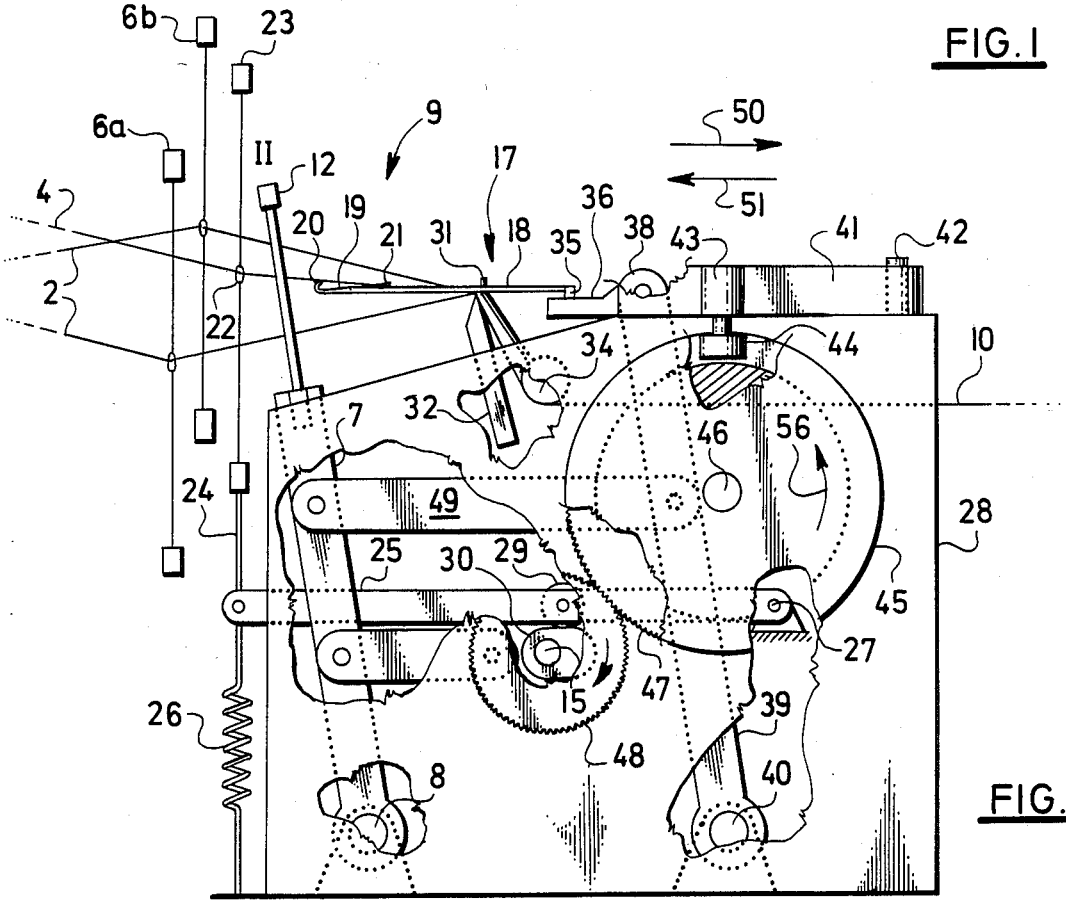
FIG. 2 is a fragmentary view in side elevation of the knit-weaving machine of FIG. 1, the view including the side wall of the machine which is adjacent to the reader.

Turning first to FIGS. 1–3 incl., which illustrate the first preferred embodiment of the machine disclosed herein, such machine has a warp beam 1 with warp threads 2 which form the sheds of the machine, a weft beam 3 with weft threads 4 which are knitted within the sheds, a back rail 5, a loom harness 6 with heald frames 6*a*, 6*b*, a slay 7 journalled about a stationary slay pivot pin 8, and a knitting mechanism 9. A fabric 10 which is being produced by the machine is pulled therefrom by a take-up device 11. Take-up device 11 has a conventional take-off surface roller 57, a pressure roller 58, and a take-up beam 59, all of which constitute parts of a conventional cloth take-up motion which is not otherwise shown in detail.

The slay 7, carrying a reed 12 is coupled through a connecting rod 13 with the crankshaft 15 of the machine through a crank 14 so as to swing between its front position I, (at the right in FIG. 1) as shown in dash-line contour and its rear or left-hand full line position II.

The motion of the loom harness 6 is controlled by means (not shown) such as, for instance, a lever mechanism actuated by a system of shedding cams provided on a camshaft which is driven via a gear set from the crankshaft 15 of the machine.

The knitting mechanism 9 includes a system of lapping elements 16 and a system of the same number of knitting needles with closeable hooks, such as, for example, hook needles, latch needles, or compound needles. In an exemplary embodiment of the machine, shown herein, there are used conventional latch knitting needles 17 each of which has a stem 18, a breast 19, a hook 20, and a latch 21.

The lapping elements, which are generally designated 16 in FIGS. 1 and 2, are constituted by heald eyes 22 of an auxiliary heald frame 23 which is coupled through a tie rod 24 with a treadle 25 suspended on a spring reverse motion 26 and journalled upon a cross shaft 27 fixed at its end in the opposite side walls 28, 28' of the machine. A cam disk 30 is keyed to the carnkshaft 15, the peripheral surface of the cam 30 being engaged by a cam follower roll 29 which is rotatably mounted upon the treadle 25 at a point intermediate the length of the latter.

The heald frames *6a, 6b* and the auxiliary heald frame 23 are mounted for vertical reciprocation in guideways (not shown) provided on each side of the machine frame.

In the knit-woven machine disclosed in the above-cited U.S. Pat. No. 3,746,051, the knitting needles are movable parallel to the warp threads, from their front position in which their hooks are disposed in front of the beat-up edge of the fabric, to their lapping position in an open shed, and back again.

In contradistinction to that, the knitting needles 17 in the machine of the present invention are caused to swing, in weaving sheds which follow one after the other, alternately to a right-hand lapping position and then to a left-hand lapping position, the hooks of the needles making a multi-phase movement caused by an interaction of means for knitting needle motion from the front position thereof to the rear position thereof, and means for sideward motion thereof in a sucessive shed.

The knitting needles 17 are mounted by their stems 18 to reciprocate in spacings of a guide comb 31 which is arranged immediately in front (to the right, FIG. 1) of a support bar 32 which is fixedly attached at its ends to the machine side walls 28, 28'. The edge 33 of the support bar 32 defines the beat-up edge on the fabric 10. The guide comb is secured at 31' (FIGS. 2, and 3) to a stationary guide bar 34 beneath which the fabric travels as it is being withdrawn from the machine. As shown, the support bar 32 has the upper left-hand edge thereof disposed at an angle with respect to the generally vertical main extent of such support bar.

The stem 18 of each of the knitting needles 17 terminates at the rear end thereof (to the right) opposite the hook 20 in a downwardly extending pin 35. Each of the pins 35 of the respective needles 17 is pivoted to swing in a corresponding hole in a needle bed 36, said holes being arranged in a line extending parallel to the length of the needle bed. The needle bed 36 has aligned pivot pins or stub shafts 37, 37' extending from its opposite ends, pins 37, 37' extending through holes in the rear ends of opposite support arms 39, 39' which are journalled at their forward ends about a support rod 40. The outer ends of pins 37, 37' engage corresponding arms 41, 41' which are journalled upon vertical pivot pins 42, 42' respectively to swing in a horizontal plane. The pivot pins 42, 42' are fixed in the side walls 28, 28' of the machine as shown in FIG. 3.

Each of the arms 41, 41' has a laterally outwardly extending arm 43, 43' fixed to the main part of the arm intermediate the length of the latter. The outer end of each of the arms 43, 43' journals a rotatable cam-following roller 44, 44' respectfully, such rollers being engaged in the groove 54, 54' of a corresponding cam 45, 45'. Cams 45, 45' are affixed to corresponding gears 47, 47', which are journalled upon horizontal stub shafts of which the one journalling the cam 45 and the gear 47 is shown at 46 in FIG. 2. The box cams 45, 45' are driven by gears 48, 48', respectively, which mesh with gears 47, 47', the effective diameter of gears 47, 47' being twice that of the respective gears 48, 48'. Gear 47 and cam 45 are disposed laterally outwardly of the machine side wall 28, whereas gear 47' and cam 45' are disposed laterally outwardly of the other machine side wall 28'. Gears 48, 48' are affixed to opposite ends of the crankshaft 15 of the machine, outwardly of the respective sidewalls, 28, 28' of the machine. The support arms 39, 39' are coupled through tie rods 49, 49', to the slay 7, as shown in FIGS. 1, 2, and 3 so as to follow the swinging motion of the slay.

Cams 45, 45', which provide for the axial reciprocation of the needle bed 36, arms 41, 41', support arm 39, 39' and tie rods 49, 49' constitute means for a controlled six-phase motion of the knitting needles 17 in two sheds which follow one after the other; in other words, such sheds follow each other within a single revolution of the axial motion cams 45, 45' and after two revolutions of the crankshaft 15.

As shown in FIG. 1, the needle bed 36 makes, on the one hand, a movement from its front (right-hand) position III, which is shown in dash-lines, to the left in the direction of arrow 50 to its rear position IV (FIG. *4b*) and a backward movement in the direction of arrow 51 derived from the movement of the slay 7, and on the other hand, a side movement in the direction of arrow 52 (FIG. 3) to its extreme (upper as there shown) position V, and in the direction of the arrow 53 to its extreme (lower as there shown) position VI (FIG. *5e*) derived from the axial movement of the needle bed 36 under the axial of the motion cams 45, 45'.

Each of the axial motion cam 45, 45' (FIGS. 2 and 3) has two opposite sections 54, 55 and 54', 55'; during the rotation of the cams in the direction of arrow 56 (FIG. 2) the sections 55, 55' cause the needle bed 36 to move in the direction of arrow 52 (FIG. 3) and the sections 54, 54' cause it to move in the direction of arrow 53. It will be apparent that cam sections 54 and 54' are of the same contour respective cam sections 55 and 55' and or similarly angularly disposed.

Slay pin 8, crankshaft 15, support bar 32, guide bar 34 and support bar 40 are secured by conventional means (not shown) to the side walls 28, 28' as shown in FIGS. 1 and 2.

Warp threads 2 threaded in the heald frames *6a, 6b*, and weft thread 4 threaded in eyes 22 of the auxiliary heald frame 23 pass through the reed in plain draft.

Within one revolution of the crankshaft 15, the slay 7 is moved from the front position I to the rear position II and back again, and together with it the support arms 39, 39' (FIGS. 1–3) also move similarly. It is an object of the cam disc 30 reliably to secure the lapping of weft threads 4 into hooks 20 of the knitting needles 17 by means of the heald eyes 22, which assume, during the afore-mentioned six-phase knitting needle motion cycle, particular positions as hereinafter explained more in detail.

FIGS. *4a, 4b, 4c, 4a', 5d, 5e, 5f*, and *5d'*, shown main positions of the knitting needles 17 in the course of the six-phase motion cycle thereof and FIGS. $4a_1$, and $5b_1$, and FIGS. $5d_1$, and $5e_1$ show in top view intermediate positions of the knitting needles 17 in the course of the six-phase motion cycle. FIGS *6a, 6b, 6c* and *6a'* shows in side elevation the main positions of a knitting needle 17 which correspond to the similarly designated FIGS. *4a, 4b, 4c, 4a'*, and the intermediate positions FIGS. $6a_1$ and $6b_1$ which correspond to FIGS. $4a_1$, and $4b_1$.

In FIGS. *4a–4a'*, incl., and in FIGS. *5d–5d'*, incl., there are shown positions of the needle bed 36, a knitting needle 17, guide comb 31, and reed 12 in top view, and in FIGS. *6a–6a,'* incl., there are shown the positions of the needle bed 36, knitting needle 17, guide comb 31, reed 12, eye 22 of the auxiliary heald frames 23 and heald frames *6a, 6b* in side elevation. Each knitting needle 17 cooperates with two weft threads 4 lying to the left and to the right of each needle in the front position thereof. For the sake of clarity, the left-hand weft thread is indicated by the character *4a*, and the right-hand weft thread is indicated by the reference character *4b*, while the warp thread group lying between said weft threads *4a, 4b* is indicated by the character *2a* (FIGS. *4a* et seq. and FIG. *5d* et seq.)

In the six-phase motion cycle the knitting needles operate as follows:

PHASE 1

The hook 20 of the knitting needle 17 follows a curvilinear path from the front position A, FIGS. 4 and 6, to the left-hand lapping position B (FIGS. *4b* and *6b*). In the front position A the knitting needle 17 is oriented parallel to the warp threads 2 (FIG. *4a*) and its hook 20 slightly overlaps the guide comb 31; the heald frames *6a, 6b* are in closed shed positions (FIG. *6a*), the heald eye 22 with threaded-in weft *4a* is in the initial position VII above the warp threads 2 while the shed is closed, the reed 12 is in the front position I and the needle bed 36 is in the front position III.

During phase 1 (FIGS. $4a_1$, $6a_1$) a warp thread shed is being built, due to the lift of the heald frame *6a* (arrow 61) and the reverse motion of the heald frame *6b* (arrow 60), the reed 12 is moved to its rear position II, and the knitting needle 17 in the guide comb 31 swings to the position corresponding to the movement of the needle bed 36 in the direction of the arrows 50, 52 (FIGS. $4a_1$, $6a_1$). Simultaneously with the movement of the heald frames *6a, 6b*, the heald eye 22 rises to the upper position VIII in the direction of arrow 62 (FIGS. $6a_1$). This movement of the heald eye 22 causes the hook 20 of the knitting needle 17 to enter the opening shed under the weft section *4a* defined by said eye 22 and the beat-up edge of the fabric 10.

At the end of the phase 1 (FIGS. *4b, 6b*) the reed 12 is in the rear position II, the needle bed 36 is in the right-hand extreme position V and the rear position IV while the shed is fully open, and the hook 20 of the knitting needle 17 is in the left-hand lapping position B in which a normal projection of the weft thread *4a* crosses the breast 19 of the knitting needle 17 before the knitting needle 17 has reached the left-hand lapping position B, the eye 22 drops from the upper position VIII (arrow 63) to a securing position IX (FIG. *6b*) in which the weft thread *4a* is caused to bear upon the breast 19 of the knitting needle 17.

PHASE 2

The hook 20 of the knitting needle 17 returns along the curvilinear path from the left-hand lapping position B into an aligning position C (FIGS. *4c, 6c*) in which the knitting needle is oriented again in parallel to warp threads 2.

FIG. $6b_1$ shows the intermediate position in which the heald frame *6a* is lowered in the direction of the arrow 60, and the heald frame *6b* is lifted (arrow 61) up to the closed shed position, further the backward movement of the needle bed 36 (arrows 51, 53, FIG. $4b_1$) and simultaneously the movement of the eye 22 in direction of arrow 63 in its lower position X (FIG. $6b_1$) whereby the weft thread *4a* is caused reliably to slide down the breast 19 of the needle into the open hook 20 of the returning knitting needle 17. In its lower position X, the eye 22 lies in the proximity of the lower shed plane of warp threads 2. The position of the needle bed 36 at the end of phase 2 (FIGS. *4c* and *6c*) corresponds to its intermediate position of FIG. $4a_1$ and FIG. $6a_1$, respectively. $6a_1$, respectively.

PHASE 3

This phase comprises the backward straight movement of the hook 20 of the knitting needle 17 to the front position A, said movement being derived from the movement of the needle bed 36 in the direction of arrow 51 to the front position III. In this time, the heald frames *6a, 6b* terminate their movements up to the closed shed positions, the eye 22 returns to the initial position VII, and the reed 12, in its front position I, beats up the connecting loop 64 formed of the weft thread *4a* along the beat-up edge, into the fabric (FIGS. *4a'* and *6a'*).

During the return of the knitting needle 17 to the front position A, the weft thread *4a* is trapped in the open hook 20 of the needle while the old stitch formed in the previous knitting phase and drawn over the stem 18 tilts the latch 21 down to close the hook 20 (FIG. *6a'*), said old stitch being drawn over the new one entrapped in the hook 20. During the next movement of the knitting needle 17 from the front position A into one of the lapping positions, the new stitch tilts up the latch 21 so that the knitting needle 17 enters the opening shed with the open hook 20.

To prevent the hook 20 from being spontaneously closed by the latch 21 as the knitting needle 17 enters the opening shed, it is necessary that the needle follows, from the very beginning, the curvilinear path since the warp thread 2 of the upper shed plane which lie askew to the longitudinal needle axis, do not allow the latch 21 to close the hook 20.

Phase 3 is followed by phases 4 to 6 (FIGS. *5d, 5e, 5f*, and *5d'*) wherein the hook 20 of the knitting needles 17 is moved, after the shed exchange, from the front position A to the opposite right-hand lapping position D (FIG. *5c*) in which into the open hook 20 there is laid, the above-described way, due to the movement of the eye 22, the right-hand weft thread *4b* disposed at the opposite side of the warp thread group *2a*, whereupon the knitting needle returns to the front position A.

during phases 4–6 (FIGS. *5d, 5e, 5f*, and *5d'*) the paths of the reed 12 and eye 22 correspond to each other as in phases 1 through 3. Only the needle bed 36 is moved from the front position III (arrows 53, 50), to the left-hand and extreme position VI and the rear position IV, and back again in the direction of arrows 51,52 to the front position III (FIG. $5d_1$).

In operation, the knitting needles 17 (FIG. 4) are moved from the initial position A over the warp thread group *2a* into the left-hand lapping position B and engage the left-hand weft threads *4a* lying to the left of said group 2*a*, and during their being up into the fabric 10 by the reed 12. After the beat-up the knitting needle 17 enter the new opening shed while the old stitches are simultaneously drawn over the new ones and are moved into the right-hand lapping position D (FIG. 5) in which they engage the right-hand weft thread 4*b* disposed to the right of the warp thread group 2*a*. In this way there formed a warp knit binding (FIG. 7) comprising wales 65 of stitches built alternately from stitches of the weft threads 4*a*, 4*b*, the connecting loop 64 being interlaced with the warp thread groups 2*a* in a weave. The warp knit binding shown in FIG. 7 is disclosed and claimed in coassigned U.S. Pat. No. 3,880,202, dated Apr. 29, 1975, of Mohelnicky et al.

In the exemplary embodiment of the knit-weaving machine, the lapping elements are constituted by heald eyes of the auxiliary heald frame controlled by a cam which, due to its characteristic, secures the operative motions of the weft threads during the above described six-phase knitting needle motion cycle. The auxiliary heald frame 23 may be, optionally, controlled independently by a dobby as it is usual in the heald frame control art.

The lapping elements can be, optionally, constituted by other means than the eyes of the auxiliary heald frame, provided such means are capable of ensuring the programmed lifting and dropping of weft threads during the knit-weaving cycle.

The time periods of the individual phases of knitting needle motions can be adjusted by appropriately shaping the groove of the radial cam 30 in order to optimalize the cooperation of the knitting mechanism, the shedding means and the slay motion producing knit-woven fabric of the desired type and quality.

The mechanism for producing the operative knitting needle motion in the individual phases of the knit-weaving cycle can even be based upon a principle which is different from that hereinabove described and shown. For the sake of simplicity, it may be, for example, preferable kinematically to invert the functions of the needle bed 36 and the guide comb 31. In this case the guide comb 31 is given a lateral linear reciprocatory movement, and the needle bed 36 is moved from the front into the rear position and back only. This alternative embodiment is shown, by way of example, in FIGS. 8 and 9. In this embodiment, the needle bed 36 is provided at either side in the axial direction with relatively short pivots pins 37*a*, 37*a*′ FIG. 9 which are rotatable in beds 38, 38′ of the support arm 39, 39′ which are in turn mounted for rotation in the support rod 40 and are connected through tie rods 49, 49′ with the slay 7. In this embodiment, for simplicity, the mechanism for reciprocatory side movement of the needle bed 36 (FIG. 3) is omitted in FIGS. 8 and 9.

The guide bar 34 supporting the guide comb 31 is fixedly attached by connecting means to the support bar 32*a*, the lower part of which is mounted for axial reciprocation in bearings 66, 66′ provided on the side walls 28, 28′ of the machine. The sides of said support bars 32*a* engage radial cams 67, 67′ on vertical shafts 68, 68′ outside the side walls 28, 28′, said shafts being supported bearing 69 on the side walls 28, 28′. To the vertical shafts 68, 68′ there are fixed helical gears 70, 70′ which mess, in a gear ration of 2:1, with helical gears 71, 71′ respectively, secured on the crankshaft 15 of the machine.

During the rotation of the crankshaft 15, there are driven via helical gears 71, 71′ the radial cams 67, 67′ by which the guide comb 31, as the shed is being built, is moved from its initial position (not shown) in the direction of arrow 72 into the left-hand extreme position XI (FIG. 9), and, in the direction of arrow 73, back into the initial position, and during the next shed, again from its initial position in the direction of arrow 73 into the right-hand extreme position (not shown) back again in the direction of arrow 72 into the initial position.

In the operation of the machine shown in FIGS. 8 and 9, there is produced, by the interaction of the motion of the needle bed 36 in the directions of the arrows 50. 51 and the motion of the guide comb 31 in the directions of arrows 72, 73, the operative motion of the knitting needles 17 comprising the above described phases I through VI incl., as illustrated in FIGS. 4*a*–4*a*′, incl., FIGS. 5*d*–5*d*′, incl., and FIGS. 6*a*–6*a*′ incl., Although the invention is described and illustrated with reference to a single of embodiment thereof, it is to be expressly understood that it is in no way limited to the disclosure of such preferred embodiment but is capable of numerous modifications within the scope of the appended claims.

We claim:

1. In a knit-weaving machine, having a crankshaft, slay together with a reed, means for reciprocating the slay between a front and a rear position, a loom harness for warp threads, means for controlling the harness motion, and a knitting mechanism for forming a warp knit binding, said mechanism comprising a system of lapping elements threaded with weft threads withdrawn from a supply disposed outside the shed, means for controlling the motion of said lapping elements, a system of knitting needles having closeable hooks and arranged in a needle bed, and means for controlling the motion of said needle bed between a front position in which the knitting needle hooks are disposed in front of the beat-up edge of fabric and longitudinally aligned with the warp threads, and a rear position in open shed, said motion of the needle bed being synchronized with the lapping element motion, the improvement wherein the lapping elements are movable between an upper position and a lower position, the lapping elements cooperate with the knitting needles, the knitting needles being mounted, on the one hand, for rotation in the needle bed in a plane parallel to the beat-up edge of fabric and, on the other hand, for reciprocation in spacings of a guide comb arranged in parallel to the beat-up edge of the fabric produced by machine, the means for controlling the motion of the needle bed being associated with means for producing a reciprocatory side motion of one of the members of the pair of needle bed and guide comb relative to each other in order to control a multi-phase motion of the knitting needles in sheds following one after the other, during which motion, in the odd-numbered sheds, the paths of the hooks of the knitting needles are oriented from the front position into the left-hand lapping position and back again into the front position into the right-hand lapping position and back again into the front position, said paths of the hooks of the knitting needles being oriented symmetrically to the longitudinal axes of the knitting needles while being in their front position.

2. A knit-weaving machine as claimed in claim 1, wherein the multi-phase motion of the knitting needles comprises, in the odd-numbered sheds and in the first phase, a motion of the hooks of the knitting needles along a curvilinear path from the front position in which the knitting needles lie parallel to warp threads, into the left-hand lapping position in which they lie askew under left-hand weft threads disposed to the left from warp thread groups, in the second phase, the backward motion of the hooks of the knitting needles with entrapped left-hand weft threads along a shorter curvilinear path into an aligned position in which the knitting needles lie again parallel to the warp threads, in the third phase, the straight motion of the hooks of the knitting needles into the knock-over front position while the shed is exchanged, in the fourth phase and the even-numbered shed, the motion of the hooks of the knitting needles along a curvilinear path from the front position into the right-hand lapping position in which the knitting needles lie askew under the right-hand weft threads disposed to the right of the warp thread groups, in the fifth phase, the backward motion into the aligning position, and in the sixth phase, the straight motion into the knock-over front position, the lapping elements arranged between the harness and the reed making a controlled motion from the initial position above the warp threads in a closed shed into the upper position during the opening shed, into a securing position before the end of the second phase, into the lower position, and into the initial position while the shed is being closed.

3. A knit-weaving machine as claimed in claim 2, wherein the motions for the needle bed and the slay are synchronized to provide a constant spacing between the reed and the hooks of the knitting needles during their operative movement.

4. A knit-weaving machine as claimed in claim 2, wherein the lapping elements are constituted by eyes of an auxiliary heald frame coupled through a leverage system with a cam secured on a crankshaft of the machine.

5. A knit-weaving machine as claimed in claim 1, wherein the guide comb is stationary and the needle bed is provided at either side in an axial direction with a pivot which is made reciprocatory in a bed of a rotatable support arm and which abuts rotatable arm a follower of which is led in the groove of a rotatable axial cam intergral with a first gear meshing, in a gear ratio of 2:1, with a second gear secured on the crankshaft of the machine, the support arms being coupled via tie rods to the slay.

6. A knit-weaving machine as claimed in claim 1, wherein the guide comb is fixedly attached to a support arm mounted for reciprocation between radial cams provided on rotable vertical shafts which are coupled through gears, in a gear ratio of 2:1, to a crankshaft of the machine, the needle bed being provided at either side in an axial direction with a pivot rotatable in a bed of the rotatable support arms which are coupled through the tie rods to the slay.

7. A knit-weaving machine as claimed in claim 1, wherein the means for controlling the motion of the needle bed is associated with means for producing a reciprocatory side motion of the needle bed in order to control a multi-phase motion of the knitting needles and sheds following one after the other.

8. In a knit-weaving machine, having a crankshaft, slay together with a reed, means for reciprocating the slay between a front and a rear position, a loom harness for warp threads, means for controlling the harness motion, and a knitting mechanism for forming a warp knit binding, said mechanism comprising a system of lapping elements threaded with weft threads withdrawn from a supply disposed outside the shed, means for controlling the motion of said lapping elements, a system of knitting needles having closeable hooks and arranged in a needle bed, and means for controlling the motion of said needle bed between a front position in which the knitting needle hooks are disposed in front of the beat-up edge of fabric and longitudinally aligned with the warp threads, and a rear position in open shed, said motion of the needle bed being synchronized with the lapping element motion, the improvement wherein the lapping elements are movable between an upper position and a lower position, the lapping elements cooperate with the knitting needles, the knitting needles being mounted, on the one hand, for rotation in the needle bed in a plane parallel to the beat-up edge of fabric and, on the other hand, for reciprocation in spacings of a guide comb arranged in parallel to the beat-up edge of the fabric produced by machine, the means for controlling the motion of the needle bed being associated with means for producing a motion of the guide comb in order to control a multi-phase motion of the knitting needles in sheds following one after the other, during which motion, in the odd-numbered sheds, the paths of the hooks of the knitting needles are oriented from the front position into the left-hand lapping position and back again into the front position into the right-hand lapping position and back again into the front position, said paths of the hooks of the knitting needles being oriented symmetrically to the longitudinal axes of the knitting needles while being in their front position.

* * * * *